US006705576B2

(12) United States Patent
Pratt

(10) Patent No.: US 6,705,576 B2
(45) Date of Patent: Mar. 16, 2004

(54) NURSING BOTTLE SUPPORT

(76) Inventor: Devri Pratt, 9965 Miramar Pkwy., Miramar, FL (US) 33025

( * ) Notice: Subject to any disclaimer, the term of this patent is extended or adjusted under 35 U.S.C. 154(b) by 0 days.

(21) Appl. No.: 09/815,198

(22) Filed: Mar. 22, 2001

(65) Prior Publication Data

US 2002/0134895 A1 Sep. 26, 2002

(51) Int. Cl.[7] ..... A47D 15/00
(52) U.S. Cl. ..... 248/103; 248/106
(58) Field of Search ..... 248/102, 103, 248/104, 106, 229.16, 316.7, 229.26; 34/90, 97

(56) References Cited

U.S. PATENT DOCUMENTS 1,030,744 A * 6/1912 Neumann ..... 248/102
1,187,845 A * 6/1916 Kolb ..... 248/102
1,630,167 A 5/1927 Cardarella
1,900,691 A * 3/1933 Carlson ..... 248/102
2,605,069 A * 7/1952 Gillaspy ..... 248/103
2,738,152 A * 3/1956 Blackmore
D198,488 S 6/1964 Reis
3,365,153 A 1/1968 Baucom
3,977,638 A 8/1976 Woodard
4,021,013 A * 5/1977 Wiersma ..... 248/447.2
5,456,432 A 10/1995 Ennis et al.
D379,660 S 6/1997 Aube
D382,970 S 8/1997 Agopian
5,749,482 A 5/1998 Tebeau
D404,493 S 1/1999 Varlet
5,862,927 A 1/1999 Tebeau
5,873,551 A 2/1999 Jones

* cited by examiner

*Primary Examiner*—Alvin Chin-Shue

(57) ABSTRACT

A nursing bottle holder is provide for attachment to a support. A mechanical impinging device is pivotally affixed to a pair of bifurcated elevational arms. An adjustable bottle retainer is held by and pivotally affixed to the distal ends of the elevational arms. A nursing bottle is retained by the bottle retainer, and a nipple having a pressure sensor detects when a user is sucking and allows fluid flow through said nipple orifice, and alternately stops fluid from flowing through said nipple when there is no pressure.

6 Claims, 4 Drawing Sheets

NURSING BOTTLE SUPPORT

RELATED APPLICATIONS

The present invention was first described in Disclosure Document Number 463,937 filed on Oct. 21, 1999. There are no previously filed, nor currently any co-pending applications, anywhere in the world.

BACKGROUND OF THE INVENTION

1. Field of the Invention

The present invention relates generally to nursing bottle or container and a holder and, more particularly, to a nursing bottle holder with strap and a nursing bottle.

2. Description of the Related Art

A search of the prior art did not disclose any patents that read directly on the claims of the instant invention; however, the following references were considered related.

The following patents disclose a halter-type nursing bottle support.

U.S. Pat. No. 5,873,551 issued in the name of Jones;

U.S. Pat. No. 3,977,638 issued in the name of Woodard; and

U.S. Pat. No. 3,365,153 issued in the name of Baucom.

The following patents disclose the ornamental design for a baby bottle holder.

U.S. Pat. No. D 382,970 issued in the name of Agopian

U.S. Pat. No. D 379,660 issued in the name of Aube; and

U.S. Pat. No. D 198,488 issued in the name of Reis.

U.S. Pat. No. D 404,493 issued in the name of Varlet describes the ornamental design for a combined baby bottle and baby bottle holder.

The following patents describe an adjustable baby bottle holder with an attachment to a support.

U.S. Pat. No. 5,862,927 issued in the name of Tebeau;

U.S. Pat. No. 5,749,483 issued in the name of Tebeau;

U.S. Pat. No. 5,456,432 issued in the name of Ennis et al.; and

U.S. Pat. No. 1,630,167 issued in the name of Carderella.

Consequently, there is a need for an adjustable bottle holder and a nursing bottle that does not leak.

SUMMARY OF THE INVENTION

It is therefore an object of the present invention to provide an improved baby bottle holder for supporting a nursing bottle and feeding a baby thereby allowing the parent to perform other tasks simultaneously.

It is a feature of the present invention to provide an improved baby bottle holder with a pressure sensor and timer setting and an adjustable strap that moves.

Briefly described according to one embodiment of the present invention, a baby bottle with an adjustable strap for support and to prevent spillage from the bottle. The strap is an adjustable arm that holds the bottle and contains two ball and socket joints for adjustment purposes while the posterior is a clamp mechanism to attach to a chair, table, crib etc. The bottle cap has a pressure sensor that senses the baby sucking.

An advantage of the present invention is that it can be attached to any surface by using the clamps. The arms have two ball and socket joints that provide adjustability.

Another advantage of the present invention, depending on whether the baby is sucking the bottle, the bottle cap has a pressure sensor prevents spillage by stopping the flow of through the bottle cap if the baby is not sucking thereby preventing spillage.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
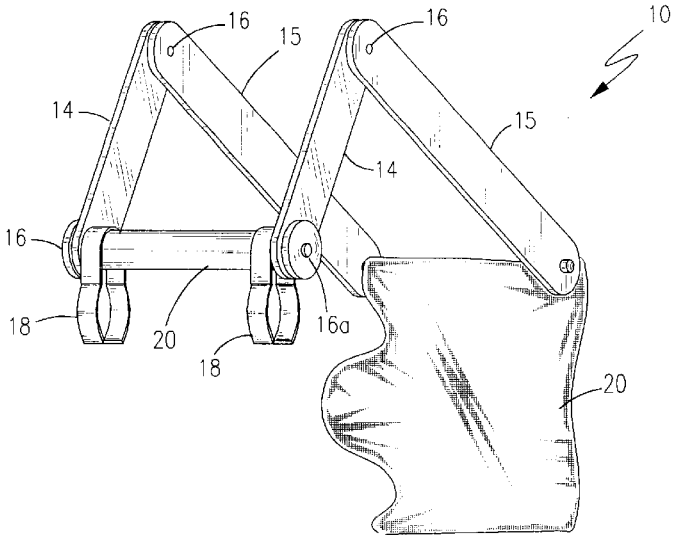
FIG. 1 is an elevational frontal view of the first embodiment of the present invention.
Figure 2:
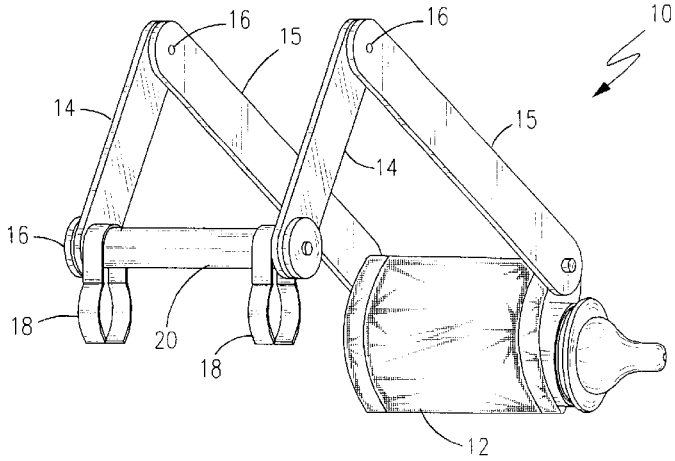
FIG. 2 is an perspective frontal view of the invention.
Figure 3:
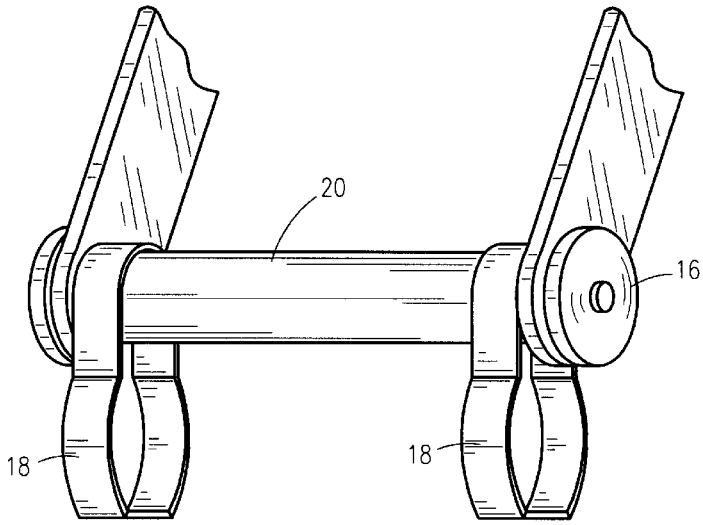
FIG. 3 is a perspective frontal view of the cylinder rod, clamp and elevational arm.
Figure 4:
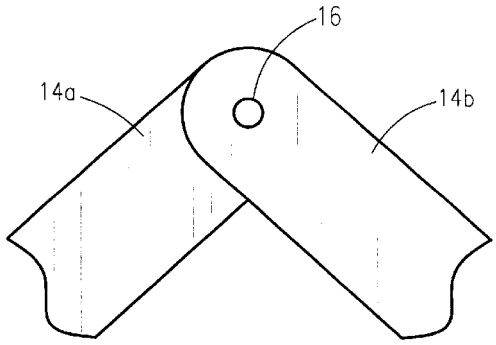
FIG. 4 is aside view of an elevating arm pivotally connected to a positional arm.

Referring now to FIGS. 1–5, a nursing bottle holder 10 for attachment to a support, according to the present invention, includes a mechanical impinging device 18, a first elevational arm 14, a second elevational arm 15, and an adjustable bottle retainer 12. The mechanical impinging device 18 is shown herein as a pair of laterally spaced clamp members, each having an apical curvature viewed along axis "I". The clamps are laterally spaced by being disposed at the distal ends of a linearly elongated cylindrical rod 20. The mechanical impinging device 18 can be made of any hard but slightly resilient material, such as plastic or metal, thereby providing an innate inward biasing force when impinged about a supporting structure such as a rail. The cylindrical rod is affixed to the apex of the arch of the mechanical impinging device 18. The first elevational arm 14 and a second elevational arm 15 are pivotally connected to the cylindrical rod 20 at each end by a first pivoting fastener 16*a*. As best shown in conjunction with FIG. 4, the first elevational arm 14 is formed in two parts: an elevating arm 14*a*, and a positioning arm 14*b*. Both the elevating arm 14*a* and positioning arm 14*b* are rigid and linearly elongated, and the anterior end of the positioning arm 14*b* is pivotally affixed to the distal end of the elevating arm 14*a* by a second pivoting fastener 16*b*. The second elevational arm is similarly formed of two separate elongated, rigid members pivotally affixed together.

Figure 5:
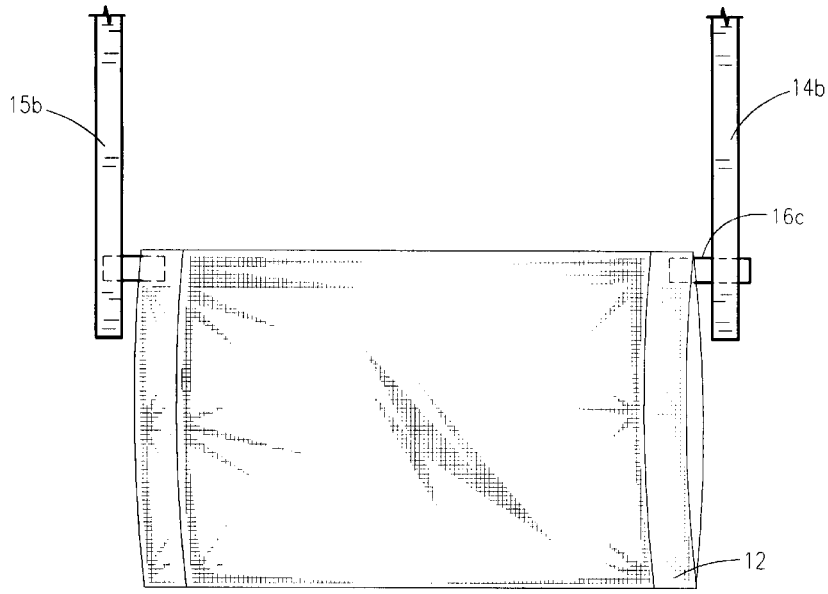
FIG. 5 is a frontal view of the positional arm, pivotally connected to the bottle holder in the present invention.
Figure 6:
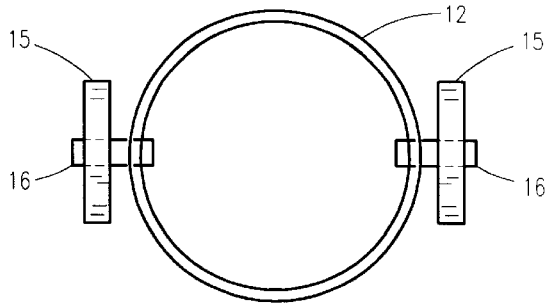
FIG. 6 is a cross-sectional view of the positional arm and bottle holder in the present embodiment of the invention.

As best shown in FIG. 5 and FIG. 6, the distal part of each arm 14, 15 is pivotally attached to the adjustable bottle retainer 12 using a connecting means such as a third pivoting fastener 16*c*. The adjustable bottle retainer 12 is made of a flexible or fabric material such as cloth or elastic material etc. that forms about and retains a nursing bottle 30.

Figure 7:
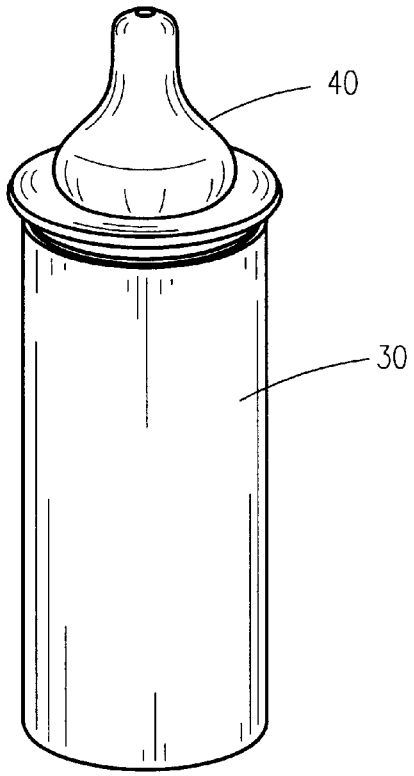
FIG. 7 frontal view of nursing bottle and bottle cap of present invention.
Figure 8:
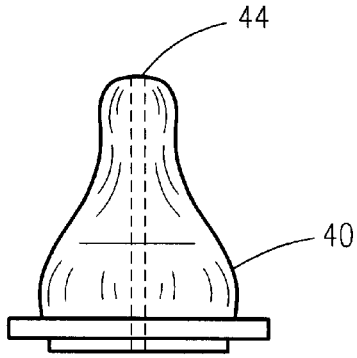
FIG. 8 cross-sectional view of the bottle cap nipple.

Referring to FIG. 7 and FIG. 8, the nursing bottle 30 has a nipple 40 with a pressure sensor 44. The pressure sensor 44 detects the baby sucking and stops the milk from flowing through the nipple 40 when there is no pressure.

2. Operation of the Preferred Embodiment

The mechanical impinging device (clamp) 18 impinges a support object such as a cylinder or quadrilateral rail. The mechanical impinging device (clamp) 18 rests on a cylindrical rod 20 and is pivotally connected on to the elevational arm 14 at the distal ends. The elevational arm 14 pivots at the I axis and is pivotally attached at the opposite distal end to the positional arm 15 thereby providing more adjustability. The positional arm 15 is pivotally attached to the bottle holder 12. The bottle holder 12 securely contains the bottle holder 12.

The foregoing description is included to illustrate the operation of the preferred embodiment and is not meant to limit the scope of the invention. As designed, a device embodying the teachings of the present invention is easily applied. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A nursing bottle holder for attachment to a support, said nursing bottle holder comprising:

a mechanical impinging device having a pair of laterally spaced clamp members, each having an apical curvature, and being affixed to and laterally spaced by being disposed at distal ends of a linearly elongated cylindrical rod having a first end opposite a second end;

a first elevational arm pivotally affixed to said first end;

a second elevational arm pivotally affixed to said second end;

an adjustable bottle retainer held by and pivotally affixed to both said first elevational arm and said second elevational arm.

2. The nursing bottle holder of claim 1, wherein each said clamp is made of a hard but slightly resilient material, thereby providing an innate inward biasing force when impinged about a supporting structure.

3. The nursing bottle holder of claim 2, wherein said cylindrical rod is affixed to an apex of said apical curvature of said mechanical impinging device.

4. The nursing bottle holder of claim 1, wherein said first elevational arm and said second elevational arm are each formed of an elevating arm pivotally affixed an distal end to an anterior end of a positioning arm by a second pivoting fastener.

5. The nursing bottle holder of claim 1, wherein said adjustable bottle retainer is made of a flexible material that forms about and retains a nursing bottle.

6. The nursing bottle holder of claim 5, wherein said nursing bottle comprises a nipple having a pressure sensor regulating said nipple orifice, whereby said pressure sensor detects when a user is sucking and allows fluid flow through said nipple orifice, and alternately stops fluid from flowing through said nipple when there is no pressure.

* * * * *